US008857236B2

(12) United States Patent
Endo et al.

(10) Patent No.: US 8,857,236 B2
(45) Date of Patent: Oct. 14, 2014

(54) FORGING DEVICE

(75) Inventors: Daisuke Endo, Kitakata (JP); Tomoo Uchida, Kitakata (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 13/996,103

(22) PCT Filed: Dec. 20, 2011

(86) PCT No.: PCT/JP2011/079495

§ 371 (c)(1),
(2), (4) Date: Sep. 9, 2013

(87) PCT Pub. No.: WO2012/086638

PCT Pub. Date: Jun. 28, 2012

(65) Prior Publication Data

US 2014/0007640 A1 Jan. 9, 2014

(30) Foreign Application Priority Data

Dec. 21, 2010 (JP) ..... 2010-284453

(51) Int. Cl.

| | |
|---|---|
| ***B21K 1/30*** | (2006.01) |
| ***B21D 45/02*** | (2006.01) |
| ***B21K 5/04*** | (2006.01) |
| ***B21D 22/02*** | (2006.01) |
| ***B21C 23/18*** | (2006.01) |
| ***B21J 13/14*** | (2006.01) |
| ***B21J 5/12*** | (2006.01) |

(52) U.S. Cl.

CPC . *B21D 22/02* (2013.01); *B21K 5/04* (2013.01); *B21C 23/183* (2013.01); *B21J 13/14* (2013.01); *B21J 5/12* (2013.01)

USPC ..... 72/344; 72/355.2

(58) Field of Classification Search

USPC ..... 72/343, 344, 352, 353.2, 355.2; 29/893.34

See application file for complete search history.

(56) References Cited

U.S. PATENT DOCUMENTS

| | | | | | |
|---|---|---|---|---|---|
| 4,509,353 | A * | 4/1985 | Ike et al. | ..... | 72/267 |
| 4,546,635 | A * | 10/1985 | Arita et al. | ..... | 72/345 |
| 4,712,411 | A * | 12/1987 | Goodwin | ..... | 72/344 |
| 5,295,382 | A * | 3/1994 | Fuhrman | ..... | 72/343 |
| 6,470,728 | B2 * | 10/2002 | Sekiguchi | ..... | 72/344 |
| 7,347,076 | B1 * | 3/2008 | Cha | ..... | 72/344 |
| 8,061,174 | B2 * | 11/2011 | Szuba et al. | ..... | 72/267 |
| 2001/0018842 | A1 | 9/2001 | Sekiguchi | | |

FOREIGN PATENT DOCUMENTS

| | | | |
|---|---|---|---|
| JP | 37-16159 | B2 | 10/1962 |
| JP | 08-057570 | A | 3/1996 |
| JP | 2002-096139 | A | 4/2002 |
| JP | 2007-075884 | A | 3/2007 |
| JP | 2011-073033 | A | 4/2011 |

OTHER PUBLICATIONS

Official Communication issued in International Patent Application No. PCT/JP2011/079495, mailed on Apr. 3, 2012.

* cited by examiner

*Primary Examiner* — David B Jones
(74) *Attorney, Agent, or Firm* — Keating & Bennett, LLP

(57) ABSTRACT

A forging device capable of producing a high-quality forged article while simplifying the structure is provided. The forging device of the present invention includes a punch 1, a die 2 having a shaping hole 22 and a helical blade portion 23 formed on an inner peripheral surface of the shaping hole, a back pressure generation mechanism 15, and a back pressure transmission mechanism. The back pressure transmission mechanism includes a rotation-side transmission member having a back pressure plate 40 and a non-rotation-side transmission member. The back pressure plate 40 is arranged in the shaping hole 22 in a fitted manner. When a forging material W1 is driven into the shaping hole 22 and the back pressure plate 40 is pressed downward by the metallic material, the back pressure plate 40 is guided by the blade portion 23 of the shaping hole 22 and thereby descends while rotating about the axis and a back pressure by the back pressure generation mechanism 15 is applied to the metallic material via the back pressure transmission mechanism.

9 Claims, 13 Drawing Sheets

FORGING DEVICE

TECHNICAL FIELD

The present invention relates to a forging device for forging a work using a die, and also relates to its related technologies.

TECHNICAL BACKGROUND

A forging device for producing a forged article is configured to obtain a forged article by placing a forging material (work) in a corresponding shaping hole formed in a lower die (die) and driving the forging material into the shaping hole by an upper die (punch) to thereby perform pressure processing of the forging material.

For example, the forging device as shown in Patent Document 1 is configured to obtain a forged article having an approximately cylindrical shape in which grooves parallel to the axial direction are formed on the outer peripheral surface thereof at equal intervals in the circumferential direction. In the forging device, groove forming protruded portions extending in the axial direction are formed on the inner peripheral side surface of the shaping hole of the die and a back pressure plate is arranged in the shaping hole. When the forging material set to the die is driven into the shaping hole by the punch, a back pressure is applied via the back pressure plate to the metallic material (metal) constituting the forging material, thereby improving the flow of the metallic material to obtain a forged article excellent in dimensional accuracy.

On the other hand, in a forging device for forming a forged article of a twisted shape having helical grooves on the outer peripheral surface thereof, a forging material is driven into a shaping hole in a screwing manner, in which helical protruded portions (blade portions) are formed on the inner peripheral side surface.

PRIOR ART DOCUMENT

Patent Document

Patent Document 1: Japanese Unexamined Laid-open Patent Application Publication No. 2007-75884

SUMMARY OF THE INVENTION

Problems to be Solved by the Invention

However, in a forging device for forming a forged article having a twisted shape, since the shape of the shaping hole is especially complex, forging without applying a back pressure to a metallic material causes problems such that unfilled portions of the metallic material are likely to occur in the shaping hole, making it difficult to obtain a high-quality forged article.

Furthermore, in such a forging device, if it is attempted to apply an appropriate back pressure to the metallic material, it is inevitable to employ a back pressure applying mechanism complex in structure, which causes problems such as complicating the structure and increasing the production cost.

The preferred embodiments of the present invention were made in view of the aforementioned technical background and/or other problems. The preferred embodiments of the present invention can significantly improve upon the existing methods and/or devices.

The present invention was made in view of the aforementioned problems, and aims to provide a forging device capable of assuredly obtaining a high-quality forged article having a twisted shape while simplifying the structure and reducing the production cost, and also provide its related technologies.

The other objects and advantages of the present invention will be apparent from the following preferred embodiments.

Means to Solve the Problems

The present invention provides the following means.

[1] A forging device equipped with a die having a shaping hole with upper and lower open ends and a helical blade portion formed on an inner peripheral surface of the shaping hole, a punch arranged on an upper side of the shaping hole coaxially with the shaping hole, whereby a forging material is driven into the shaping hole from above by the punch to form a forged article having a helical groove corresponding the blade portion on an outer peripheral surface thereof, the forging device comprising:

a back pressure generation mechanism arranged on a lower side of the shaping hole non-rotatably about an axis, and a back pressure transmission mechanism arranged to transmit a back pressure by the back pressure generation mechanism to a metallic material as the forging material to be driven into the shaping hole, wherein the back pressure transmission mechanism includes a rotation-side transmission member arranged rotatably about the axis, and a non-rotation-side transmission member arranged on a lower side of the rotation-side transmission member non-rotatably about the axis, a lower end of the rotation-side transmission member is arranged so as to come into contact with an upper end of the non-rotation-side transmission member rotatably about the axis, the rotation-side transmission member includes a back pressure plate for restraining a lower end of the metallic material at the time of shaping, an engaging dented portion is formed on an outer peripheral portion of the back pressure plate corresponding to the blade portion, the back pressure plate is arranged in the shaping hole in a state in which the engaging dented portion is engaged with the blade portion slidably in an up-and-down direction, and when the forging material is driven into the shaping hole and the back pressure plate is pressed downward by the metallic material, the engaging dented portion of the back pressure plate is guided by the blade portion and thereby the back pressure plate descends while rotating about the axis, and a back pressure by the back pressure generation mechanism is applied to the metallic material via the back pressure transmission mechanism.

[2] The forging device as recited in Item 1, further comprising a knock-up mechanism configured to knock up the rotation-side transmission member upward, wherein when discharging the forged article in the shaping hole upward, the rotation-side transmission member is knocked up by the knock-up mechanism and thereby the rotation-side transmission member is moved upward together with the forged article while rotating about the axis by being guided by the blade portion.

[3] The forging device as recited in Item 2, wherein the rotation-side transmission member includes a back pressure transmission bar arranged in a lower opening portion of the shaping hole in an inserted manner, and wherein an upper end of the back pressure transmission bar is fixed to a lower surface of the back pressure plate relatively non-rotatably about the axis.

[4] The forging device as recited in Item 3, wherein the back pressure transmission bar is provided, at its lower end outer periphery, with a retaining portion, and wherein the retaining portion is configured to be engaged with a lower side opening peripheral edge of the shaping hole of the die to prevent the back pressure plate and the back pressure transmission bar from being pulled out upward.

[5] The forging device as recited in any one of Items 1 to 4, wherein the back pressure plate is provided, at its outer peripheral side surface, with an oil groove for retaining lubricant to be supplied to the shaping hole.

[6] The forging device as recited in any one of Items 1 to 5, wherein the back pressure plate is provided, at its upper surface inner side, with a protruded portion for increasing a flow of the metallic material toward an outer peripheral portion of the shaping hole.

[7] The forging device as recited in any one of Items 1 to 6, wherein in a state in which a descending operation of the punch has been completed, a height of the back pressure plate in the shaping hole is held by a back pressure by the back pressure generation mechanism.

[8] A production method of a forged product, the method comprising the steps of:

obtaining the forged article using the forging device as recited in any one of Items 1 to 7; and obtaining the forged product by cutting out an excess portion of the forged article.

[9] A forging method comprising the steps of: arranging a die having a shaping hole with upper and lower open ends and a helical blade portion formed on an inner peripheral surface of the shaping hole; and driving a forging material into the shaping hole from above by a punch arranged on an upper side of the shaping hole coaxially with the shaping hole to thereby form a forged article having a helical groove corresponding the blade portion on an outer peripheral side surface of the forged article, the forging method further comprising the steps of:

preparing a back pressure plate having an engaging dented portion corresponding to the blade portion on an outer peripheral portion, the back pressure plate being configured to restrain a lower end of the metallic material as the forging material at the time of shaping;

arranging the back pressure plate in the shaping hole in a state in which the engaging dented portion is engaged with the blade portion slidably in an up-and-down direction;

providing a back pressure generation mechanism on a lower side of the shaping hole non-rotatably about an axis;

providing a rotation-side transmission member including the back pressure plate rotatably about the axis;

providing a non-rotation-side transmission member between the rotation-side transmission member and the back pressure generation mechanism non-rotatably about the axis;

arranging a lower end of the rotation-side transmission member so as to come into contact with an upper end of the non-rotation-side transmission member rotatably about the axis, and when the forging material is driven into the shaping hole and the back pressure plate is pressed downward by the metallic material, the engaging dented portion of the back pressure plate is guided by the blade portion and thereby the back pressure plate descends while rotating about the axis, and a back pressure by the back pressure generation mechanism is applied to the metallic material via the back pressure transmission mechanism.

Effect of the Invention

According to the forging device of the invention [1], since a forged article having a twisted shape is formed while applying a back pressure to the metallic material, the flow property of the metallic material during the shaping becomes good, which enables to obtain a high-quality forged article with no underfill, etc. Further, since the back pressure plate rotates while descending by being guided by the blade portion of the shaping hole, no mechanism and power to rotate the back pressure plate is required, which can simplify the structure and attain the cost reduction. Furthermore, since the back pressure generation mechanism and the non-rotation-side transmission member of the back pressure transmission mechanism are arranged in a non-rotatable manner, no mechanism and power to rotate them are required, which can further simplify the structure and attain the cost reduction.

According to the forging device of the invention [2], the forged article can be assuredly discharged using a knock-up mechanism.

According to the forging device of the invention [3], since the back pressure transmission bar is fixedly connected to the back pressure plate, when discharging the forged article, the back pressure plate can be smoothly detached from the forged article by the self-weight of the back pressure transmission bar.

According to the forging device of the invention [4], a retaining portion is provided at the lower end outer periphery of the back pressure transmission bar, which assuredly prevents the back pressure plate and the back pressure transmission bar from being pulled out upward from the shaping hole.

According to the forging device of the invention [5], an oil groove for retaining lubricant is formed on the outer peripheral side surface of the back pressure plate, thereby supplying a proper amount of the lubricant into the shaping hole from the oil groove to prevent defects such as running out of oil.

According to the forging device of the invention [6], since the protruded portion for increasing the flow property of the metallic material is formed on the upper surface of the back pressure plate, the metallic material assuredly spreads toward the outer peripheral edge portion during shaping. Therefore, a high-quality forged article not having underfill, etc., can be obtained.

According to the forging device of the invention [7], a height position of the back pressure plate at the time of completion of the shaping is held by a back pressure by the back pressure generation mechanism, thereby comfortably absorbing the load immediately before completion of the descending operation of the punch to effectively prevent defects such as generation of shock at the time of completion of the descending operation of the punch.

According to the production method of forging device of the invention [8], a high-quality forged product can be assuredly obtained.

According to the forging method of the invention [9], the same effects as mentioned above can be obtained in the same manner as mentioned above.

EMBODIMENTS FOR CARRYING OUT THE INVENTION

Next, an example of the present invention will be explained with reference to the attached drawings.

Work

In an embodiment as one example of the present invention, a forging material is forged into a forged article, and as needed, an excess portion of the forged article is cut to obtain a forged product.

Figure 3A:
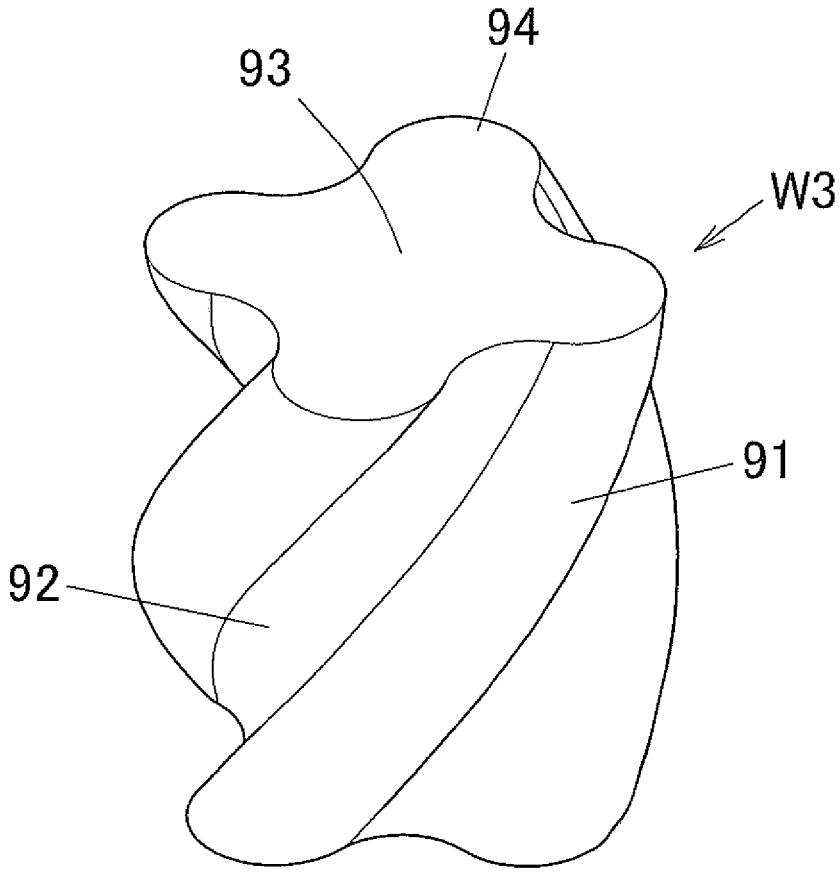
FIG. 3A is a perspective view showing a forged product to be produced by the forging process of the embodiment.
Figure 3B:
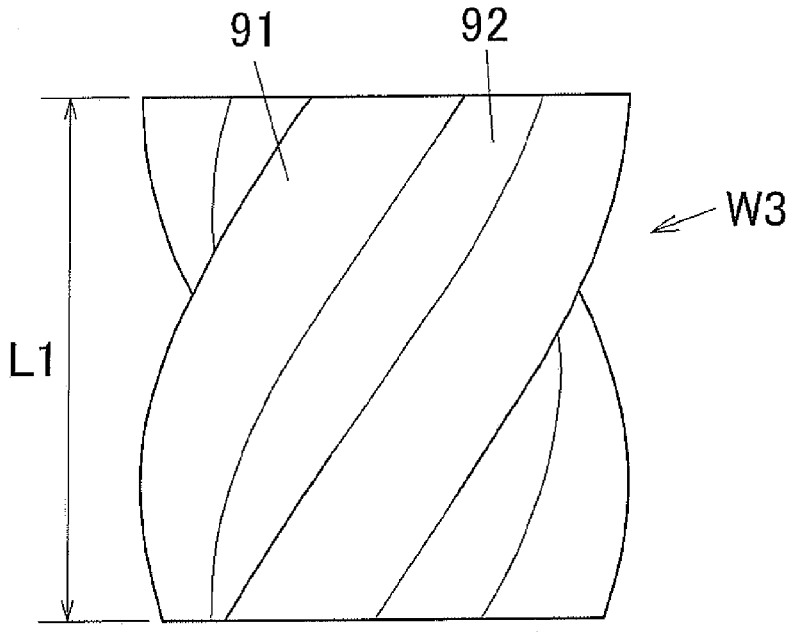
FIG. 3B is a front view showing the forged product of the embodiment.
Figure 3C:
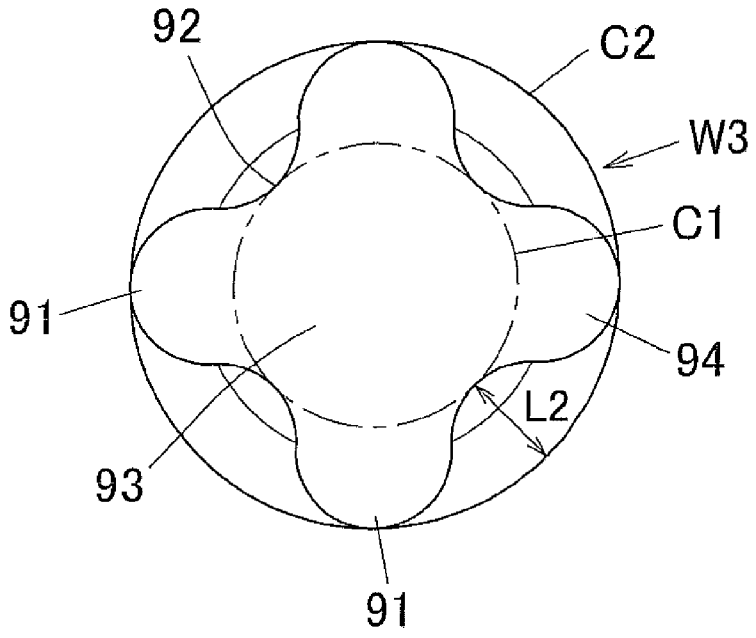
FIG. 3C is a plan view showing the forged product of the embodiment.

As shown in FIGS. 3A to 3C, the forged product W3 to be produced by this embodiment is a rotor member for use in a supercharger of an automobile. The forged product W3 as a rotor member is provided with four leaf-type twist robes. In this forged product W3, four robes 91 provided on the outer periphery have helical twisted shapes (helix shapes) extending from one end side (upper end side) toward the other end side (lower end side) in the axial direction. Therefore, between the four robes 91, four helical grooves 92 are formed from one end side (upper end side) toward the other end side (lower end side) in the axial direction. The robe 91 is formed by a helical protruded portion.

In the forged product W3 of this embodiment, the length in the axial direction (the height of the product) L1 is set to 107 mm, and the the twisting angle is set to 120°, so that each groove 92 has a phase difference of 120° between the upper end face and the lower end face of each groove 92.

The twisting angle denotes an angular difference (phase difference) of each groove 92 around the axis when the groove 92 advances from the upper end face thereof and reaches the lower end face thereof. For example, the twisting angle can be defined as an angle between two lines projected onto a planar surface centering on the axis, wherein the two lines includes a line connecting the deepest portion of the groove 92 on the upper end face and the axis and a line connecting the deepest portion of the groove on the lower end face and the axis. The twisting angle can be defined based on the apex of the robe 91 instead of the deepest portion of the groove 92.

In the forged product W3 of this embodiment, the circumscribed circle diameter C2 of the product is set to 100 mm.

In the present invention, a product having a circumscribed circle diameter C2 of 50 mm to 120 mm is preferably used.

The product to which the present invention can be preferably applied has a height L1 larger than the circumscribed circle diameter C2, e.g., L1/C2 is 1.2 to 2.2, more preferably 1.5 to 2.0.

The production method of the present invention is a forward extruding sealed method in which a material mainly spreads in the forward direction, rather than a bur forming method in which a material mainly spreads in the sideway direction when shaping. Therefore, the production method can be suitably used for producing a product having a shape in which the height L1 is larger than the circumscribed circle diameter C2.

In the present invention, a forged product W3 having a twisting angle of 60° to 120° can be suitably used. Furthermore, a forged product having a height L1 of 60 mm to 110 mm can be suitably used.

In a normal forged product W3, when the height L1 is 80 mm, the twisting angle is adjusted to 60°, and when the height L1 is 107 mm, the twisting angle is adjusted to 120°.

As shown in the plan view of FIG. 3C, in the horizontal cross-section, the dimension L2 (groove depth) in the radial direction between the virtual inscribed circle C1 passing through the deepest portion of each groove 92 of the forged product W3 and the peripheral profile line C2 passing through the apex of each robe 91 is preferably set to 10 mm to mm. In the forged product W3 of this embodiment, the groove depth L2 is set to 20 mm.

In the forged product W3, among the regions shown in the horizontal cross-section, when the inner side portion of the virtual inscribed circle C1 is defined as a center portion 93 and the portions (the portions corresponding to the robes 91) other than the center portion 93 are defined as outer peripheral spiral portions 94, the volume ratio between the center portion 93 and the peripheral spiral portions 94 (the volume of the center portion:the volume of the outer peripheral spiral portions) is preferably adjusted to 1:0.5-2. In this embodiment, the volume ratio is set to 1:1.

Further, the diameter ratio between the virtual inscribed circle C1 and the outer peripheral profile line C2 (the diameter of the inscribed circle:the diameter of the outer peripheral profile line) is preferably adjusted to 1:1.5-3. In this embodiment, the diameter ratio is set to 1:2.

Figure 4A:
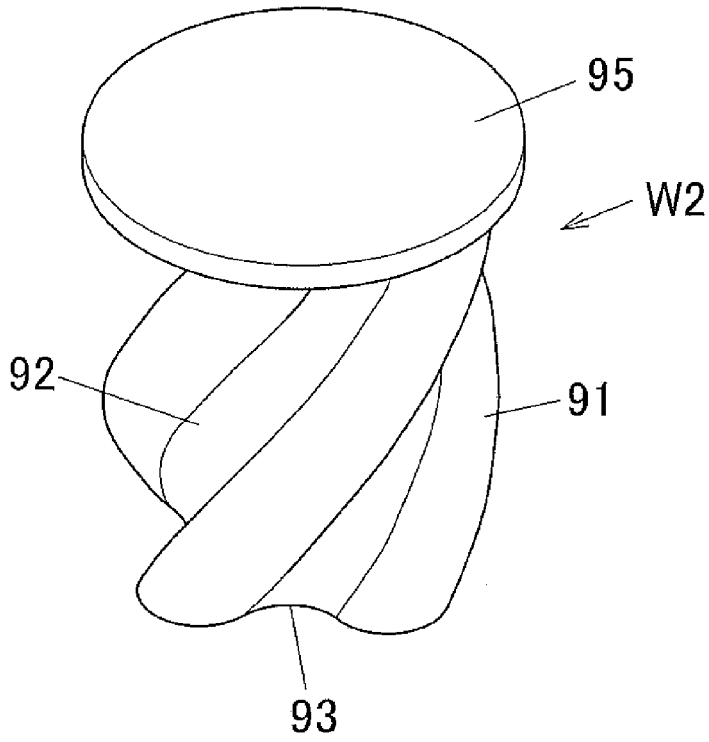
FIG. 4A is a perspective view showing a forged article to be produced by the forging device of the embodiment
Figure 4B:
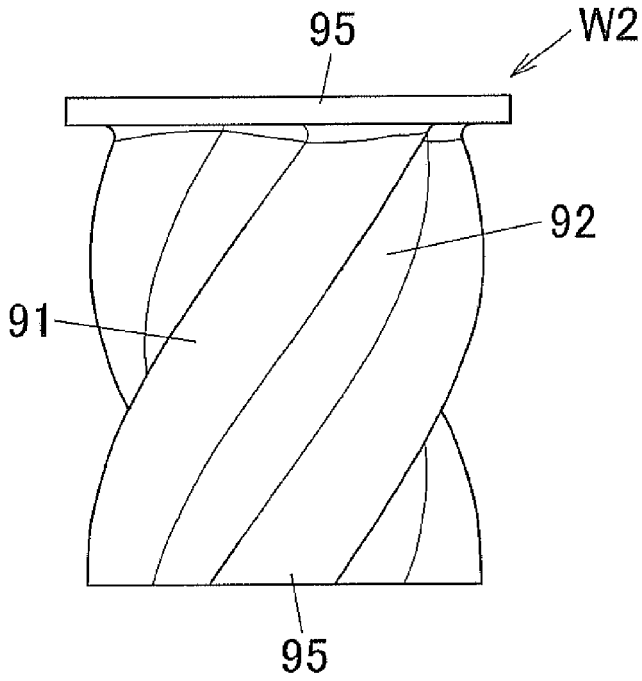
FIG. 4B is a front view showing the forged article of the embodiment.

As shown in FIGS. 4A and 4B, the forged article W2 to be obtained by a forging device which will be explained later is provided with excess portions 95 at both upper and lower end portions thereof. As described above, the aforementioned forged product W3 is obtained by cutting out the excess portions 95 from the forged article W2 as needed.

Figure 5:
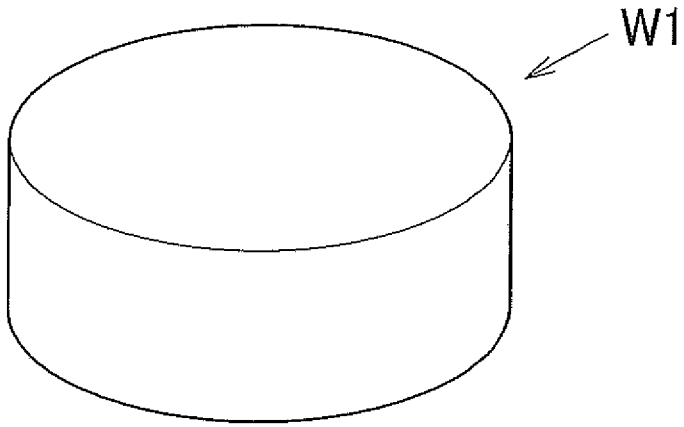
FIG. 5 is a perspective view showing a forging material to be processed by the forging device of the embodiment.

A forging material W1 as a shaping material for the forged article W2 is not specifically limited in shape, but a cylindrical shaped forging material as shown in FIG. 5 is suitably used.

As the forging material W1, a cast material, an extruded material, a forged material, an upset material, a mechanically processed material, etc., can be used. Considering the costs, however, a cut product of a continuously cast material is preferably used.

A cut material of a continuously cast material as a forging material W1 can be obtained by, for example, subjecting a cast bar material obtained by a continuous casting to a heat treatment, a pealing treatment and an ultrasonic inspection, and then cutting it.

The forging material W1 is constituted by aluminum or aluminum alloy and for example, an Al—Si—Mg alloy (6000-series alloy) and an Al—Si alloy (4000-series alloy) can be suitably used. Among them, a 6000-series alloy is suitable for the forging of this embodiment since it is easily stretched and has a good metal flow. Alternatively, a 4000-series alloy having good abrasion resistance and mechanical strength properties of a product W3 can be used.

In this embodiment, the term "work" is used to mean, including a forging material W1, a forged article W2 and a forged product W3.

The present invention can be suitably applied to products other than a rotor part of a supercharger. For example, the present invention can be suitably applied to a product having the same cross-sectional shape perpendicular to the axial direction regardless of the position in the axial direction at least at an intermediate portion in the longitudinal direction of the helical axis (the axial direction, or the direction of the product height). Furthermore, the present invention can also be suitably applied to a product having a similar shape at least at an intermediate portion in the axial direction, wherein the cross-sectional shape perpendicular to the axial direction is monotonously scaled down toward the extruded direction (downward). Further, the present invention is preferably applied to a product in which the cross-sectional shape smoothly changes in phase about the axis.

Specifically, as a member (product) which rotates about the axis, a rotor for an air/gas compressor and a rotor for an air conditioner can be exemplified.

Forging Device

FIGS. 1A to 1D are front cross-sectional views showing a forging device according to an embodiment of the present invention. As shown in these figures, this forging device includes a base stand 10, a die receiving member 12 fixed on the base stand 10, a die 2 as a lower die fixed to the die receiving member 12, and a punch 1 as an upper die arranged on the upper side of the die 2.

The die 2 includes a die main body 20 and an anvil 30 arranged at the lower end of the die main body 20.

A work mounting hole 21 opened upward at the center of the upper end portion and having a circular horizontal cross section is formed in the die main body 20. The work mounting hole 21 is configured to mount the forging material Wi1 in an inserted manner.

A shaping hole 22 is formed on the lower side of the work mounting hole 21 of the die main body 20. The upper end of the shaping hole 22 opens toward the work mounting hole 21 and the lower end thereof opens downward of the die main body 20. The shaping hole 22 is formed coaxially with the work mounting hole 21.

Four blade portions 23 for forming the grooves 92 of the forged article W2 are formed in a helical manner on the inner peripheral side surface of the shaping hole 22. Needless to say, the inner peripheral shape of the shaping hole 22 is formed corresponding to the outer peripheral shape of the forged article W2. Therefore, the protrusion dimensions, the twisting angle, etc., of the blade portion 23 are essentially the same as those of the forged product explained in the paragraph of the forged product W3 (forged article W2).

The anvil 30 is arranged on the lower surface of the die main body 20 so as to block the lower end opening of the shaping hole 22. A through-hole 31 is formed coaxially with the shaping hole 22 at the center of the anvil 30. The through-hole 31 is formed into a circular shape and the dimension of the diameter is formed to be smaller than the circumscribed circle of the shaping hole 22.

In this embodiment, the upper end opening portion of the shaping hole 22 (a portion connecting to the work mounting hole 21) constitutes an upper opening portion, and the through-hole 31 of the anvil 30 constitutes a lower opening portion of the shaping hole 22.

The punch 1 is arranged above the shaping hole 22 of the die 2 so as to coincide with the axis of the die 2 (the axis of the shaping hole 22). The punch 1 is formed so that the horizontal cross-sectional shape corresponds to the horizontal cross-sectional shape of the work mounting hole 21, and constitute so that the punch can be inserted into the work mounting hole 21 in a fitted manner.

Figure 1A:
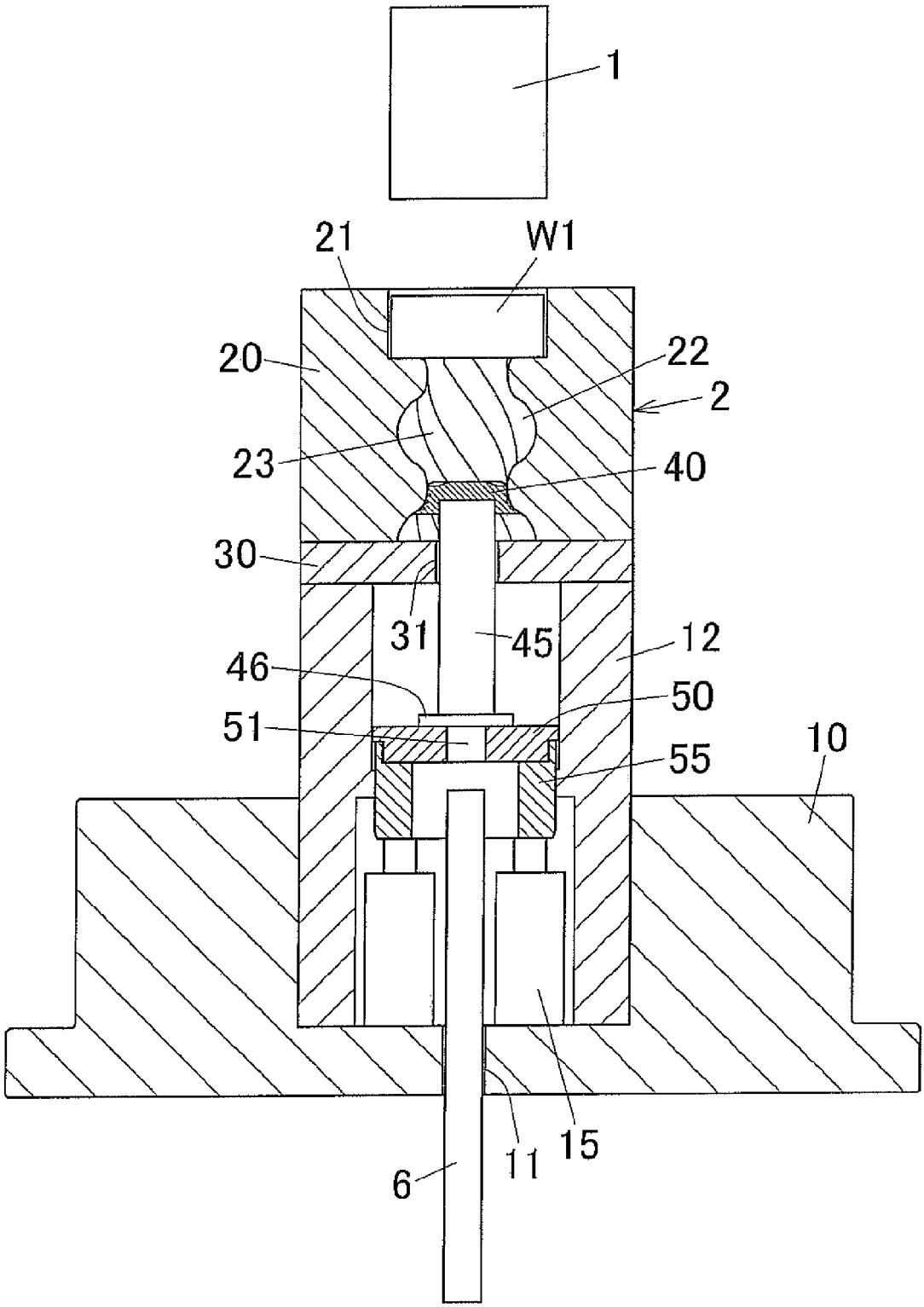
FIG. 1A is a front cross-sectional view showing a forging device of an embodiment of the present invention in a state immediately before starting the shaping operation.
Figure 1B:
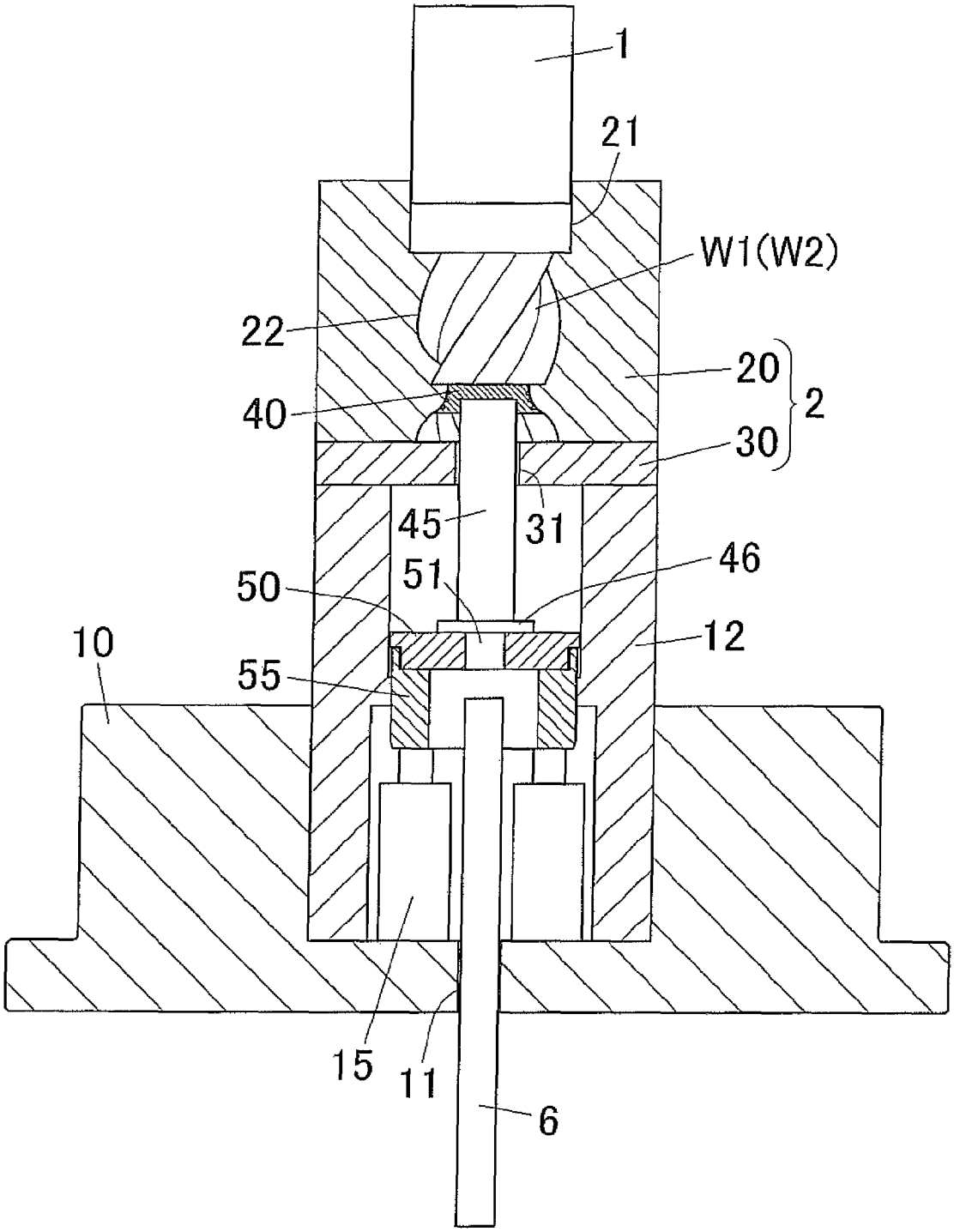
FIG. 1B is a front cross-sectional view showing the forging device of the embodiment in a state during shaping.
Figure 1C:
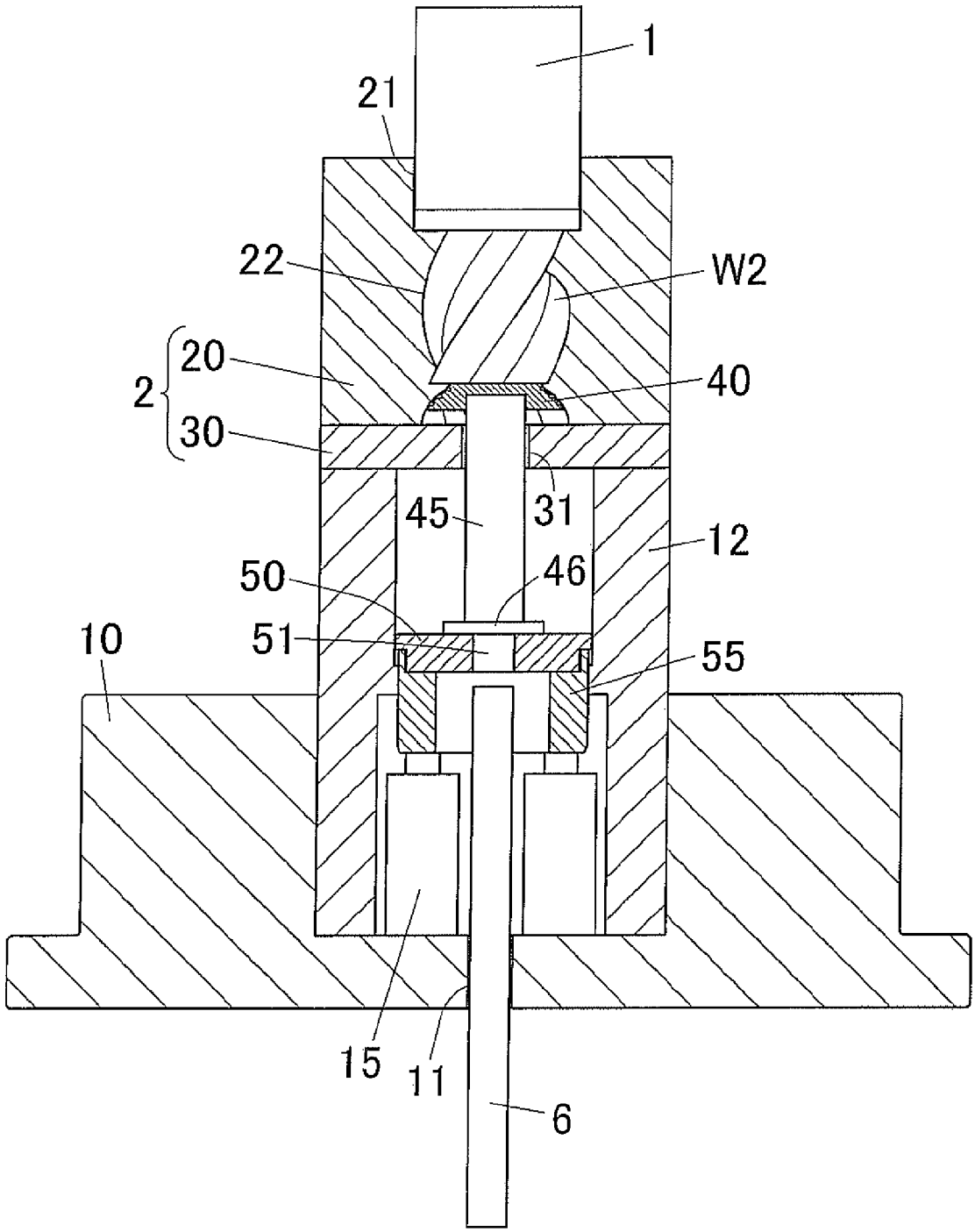
FIG. 1C is a front cross-sectional view showing the forging device of the embodiment in a state immediately after completion of shaping.

Furthermore, the punch 1 is configured to be driven in the up-and-down direction (in the axial direction) by a driving mechanism which is not illustrated. As shown in FIG. 1A, the punch 1 is, at an elevated position, arranged above the die 2 so as to face the work mounting hole 21. When the punch 1 is descended from the elevated position as shown in FIG. 1C, the punch 1 is driven to a position slightly upward from the upper end of the shaping hole 22 in the work mounting hole 21.

Figure 6A:
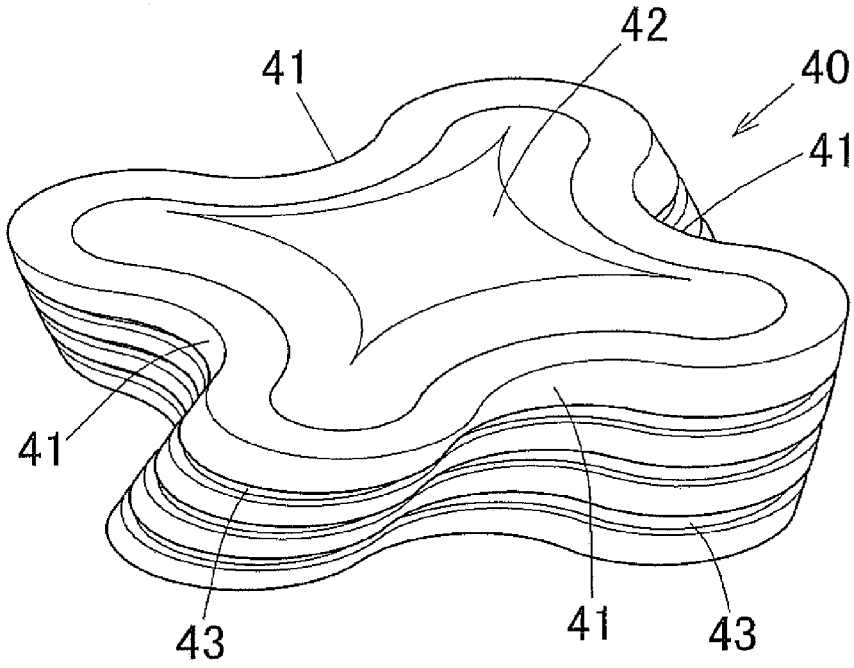
FIG. 6A is a perspective view showing a back pressure plate used for the forging device of the embodiment
Figure 6B:
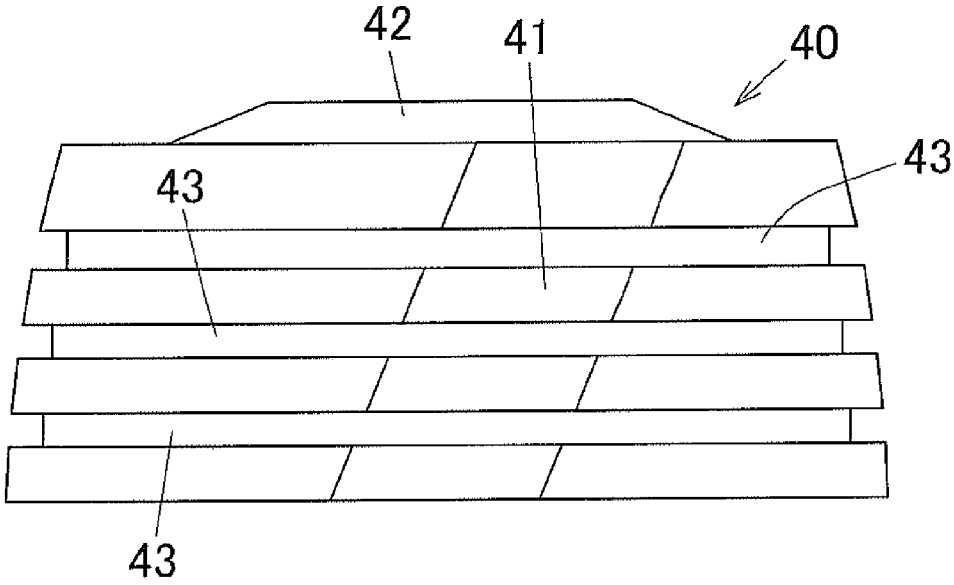
FIG. 6B is a front view showing one-half side of the back pressure plate of the embodiment.

A back pressure plate 40 that restrains the lower end of the metallic material is arranged in the shaping hole of the die 2. As shown in FIGS. 6A and 6B, the back pressure plate 40 has a horizontal cross-section shape corresponding to the horizontal cross-sectional shape of the shaping hole 22, which, in other words, is the horizontal cross-sectional shape of the forged product W3. That is, in the back pressure plate 40, four engaging dented portions 41 corresponding to the four blade portions 23 of the shaping hole 22 and the four grooves 92 of the forged product W3 are formed on the outer peripheral edge portion at equal intervals in the circumferential direction. Each engaging dented portion 41 is formed into a twisted shape (helical shape) so that the phase shifts in the circumferential direction (in the rotation direction about the axis) towards the thickness direction (in the axial direction) of the back pressure plate 40. The twisting angle of each engaging dented portion 41 corresponds to the twisting angle of the groove 92 of the blade portion 23 of the shaping hole 22 and the forged product W3, so that the blade portion 23 of the shaping hole 22 can be engaged with each engaging dented portion 41 in a fitted manner.

The back pressure plate 40 is arranged in the shaping hole 22 coaxially with the shaping hole 22 in a fitted manner. Therefore, when a downward force is applied to the back pressure plate 40, the back pressure plate 40 moves downward in the shaping hole 22 while rotating about the axis with each engaging dented portion 41 being guided by each blade portion 23. On the other hand, when a upward force is applied to the back pressure plate 40, the back pressure plate 40 moves upward in the shaping hole 22 while rotating about the axis in the opposite direction with each engaging dented portion 41 being guided by each blade portion 23.

In this way, in this embodiment, when the back pressure plate 40 ascends and descends, the sliding portion for guiding the outer peripheral side surface of the back pressure plate 40 to rotate the back pressure plate 40 is constituted by the inner peripheral side surface of the shaping hole 22. In other words, the portion provided on the shaping hole 22 to give the twisting shape to the product (the portion for twisting the product)

is also used as the sliding portion for guiding the back pressure plate 40. Therefore, there is no need to provide a sliding portion for guiding the back pressure plate separately from and independently of the inner peripheral side surface of the shaping hole 22.

For instance, if a sliding portion for guiding the back pressure plate is provided separately from the portion for twisting the product, the portion for twisting the product and the sliding portion must be formed with a sufficient degree of accuracy, requiring a difficult adjustment at the time of assembling the die assembly.

On the other hand, in this embodiment, since there is no sliding portion exclusive for the back pressure plate as mentioned above, there is no need to adjust the portion for twisting the product and the sliding portion exclusive for the back pressure plate at the time of assembling the die, resulting in an easy assembly of the die.

In the back pressure plate 40, it is preferable to provide a protruded portion 42 at a region (inner region) other than the outer peripheral edge portion on the upper surface of the back pressure plate 40 in such a way that the region swells upward. The back pressure plate 40 can be rotated more assuredly during the ascending and descending operations by the protruded portion 42. The protruded portion 42 is preferably provided at an area broader than the contact surface of the back pressure transmission bar 45 and the back pressure plate 40.

Furthermore, the protruded portion 42, as explained later, has a function to increase the outward flow of the metallic material (metal flow) in the shaping hole 22.

Furthermore, oil grooves 43 are formed on the outer peripheral end surface (outer peripheral side surface) of the back pressure plate 40. In this embodiment, a plurality of oil grooves 43 are formed on the outer peripheral surface of the back pressure plate 40 so as to extend continuously in the circumferential direction and arranged at predetermined intervals in the thickness direction (axial direction). Lubricant can be retained in the oil grooves 43 and as explained later, the lubricant can be accordingly supplied to the shaping hole 22.

In the present invention, the number of the oil grooves 43 is not limited, and there can be a single groove or a plurality of grooves. Furthermore, the direction of the oil groove 43 is not limited. For example, the direction of the oil groove 43 can be matched in the longitudinal direction of the back pressure plate 40 (in the thickness direction, in the main forming direction), or it can be matched in the lateral direction (in the circumferential direction) of the back pressure plate 40.

When forming the oil groove 43 on the outer peripheral surface of the back pressure plate 40 along the circumferential direction, the oil groove 43 is preferably formed into a deformed helical shape inclined with respect to the horizontal plane. In forming the oil groove 43 in a deformed helical shape, in a plan view, for example, in cases where the back pressure plate 40 rotates clockwise during the descending operation, the oil groove 43 is preferably formed so as to advance downward gradually as it advances in the counterclockwise direction along the outer peripheral surface of the back pressure plate 40. Metaphorically, when the descending back pressure plate 40 behaves like a right screw, the oil groove 43 is preferably formed along a screw groove of a left screw. On the other hand, when the back pressure plate rotates in the counterclockwise direction during the descending operation, the oil groove 43 is preferably formed so as to advance downward gradually as it advances in the clockwise direction along the outer peripheral surface of the back pressure plate 40. Metaphorically, when the descending back pressure plate 40 behaves like a left screw, the oil groove 43 is preferably formed along a screw groove of a right screw.

By shaping the oil groove 43 as mentioned above, an excessive amount of lubricant can be prevented from flowing out from the oil groove 43 when the back pressure plate 40 ascends. This prevents an occurrence of a shortage of lubricant at the time of ascending the pressure plate, which improves the lubricant storing effect.

In this embodiment, since the back pressure plate 40 restrains the lower end surface of the metallic material during shaping, it can be considered as a restraining plate.

The die receiving member 12 arranged on the lower side of the die 2 has, at its inside, a hollow portion which extends along the axial direction. In the inner portion of the die receiving member 12, a back pressure transmission bar 45, a back pressure transmission plate 50, a connecting member 55, a hydraulic cylinder 15, a knockout pin 6, etc., are provided.

The back pressure transmission bar 45 is arranged in the through-hole 31 of the anvil 30 coaxially with the back pressure plate 40 in an inserted manner. The upper end of the back pressure transmission bar 45 is fixedly connected to the back pressure plate 40 in a state in which its relative rotation with respect to the back pressure plate 40 is restricted. Therefore, as explained above, when the back pressure plate 40 ascends and descends while rotating, the back pressure transmission bar 45 slides up and down while rotating together with the back pressure plate 40.

A retaining flange 46 constituting a retaining portion is provided on the lower end outer periphery of the back pressure transmission bar 45 in a radially outwardly protruded manner. When the back pressure transmission bar 45 ascends to a position where the lower end reaches the lower surface of the anvil 30, the retaining flange 46 comes into contact with and is engaged with the peripheral edge portion of the through-hole 31 at the lower surface of the anvil 30 to assuredly prevent the back pressure transmission bar 45 from being pulled out upward.

In this embodiment, a male screw is formed at the upper end of the back pressure transmission bar 45, and a female screw is formed at the center of the lower surface of the back pressure plate 40, and the back pressure transmission bar 45 is fixed to the back pressure plate 40 in a state in which the male screw is screwed into the female screw. In this embodiment, it is configured so that the direction in which the back pressure plate 40 is rotated when tightening a screw with respect to the back pressure transmission bar 45 and the direction in which the back pressure plate 40 rotates when ascending are the same. On the other hand, it is configured so that the direction in which the back pressure plate 40 rotates when loosening a screw with respect to the back pressure transmission bar 45 and the direction in which the back pressure plate 40 rotates when descending are the same. That is, the screws are formed so that the connection of the back pressure plate 40 and the back pressure transmission bar 45 becomes strong when both of them ascend.

In the present invention, however, the connection method of the back pressure transmission bar 45 and the back pressure plate 40 is not limited to screwing, but any connection methods can be employed as long as the back pressure transmission bar 45 and the back pressure plate 40 are connected in a manner such that their relative rotation is restrained.

The back pressure transmission plate 50 is arranged on the lower side of the back pressure transmission bar 45 coaxially with the back pressure transmission bar 45. The back pressure transmission plate 50 is constituted so as to be movable along the up-and-down direction (axial direction) in the die receiving member 12 so as not to rotate about the axis.

A through-hole 51 is formed at the center portion of the back pressure transmission plate 50. The through-hole 51 is formed coaxially with the back pressure transmission bar 45, and has an inner diameter smaller than an outer diameter of the back pressure transmission bar 45. The lower end peripheral edge portion of the back pressure transmission bar 45 can be arranged on the peripheral edge portion of the through-hole 51 of the upper surface of the back pressure transmission plate 50. In the arranged state (contacted state), the back pressure transmission bar 45 can rotate with respect to the back pressure transmission plate 50. When the back pressure transmission bar 45 descends while rotating together with the back pressure plate 40, the back pressure transmission plate 50 descends without rotating by being pushed by the back pressure transmission bar 45. Furthermore, when the back pressure transmission plate 50 ascends without rotating, the back pressure transmission bar 45 is pulled up by the back pressure transmission plate 50 and ascends while rotating together with the back pressure plate 40.

When the forged article W2 is discharged by the knockout pin 6 as will be explained later, the back pressure transmission bar 45 is detached from the back pressure transmission plate 50. Therefore, in this embodiment, the lower end of the back pressure transmission bar 45 is arranged such that the lower end of the back pressure transmission bar 45 comes into contact with the upper surface of the back pressure transmission plate 50 in a rotatable manner about the axis.

A connecting member 55 arranged on the lower side of the back pressure transmission plate 50 has an approximately cylindrical shape. In a state in which the connecting member 55 is arranged coaxially with the back pressure transmission plate 50, the upper end portion of the connecting member 55 is fixed to the lower end outer peripheral portion of the back pressure transmission plate 50. The connecting member 55 can move in the up-and-down direction (axial direction) in a state in which the connecting member does not rotate together with the back pressure transmission plate 50 about the axis.

A plurality of hydraulic cylinders 15 facing upwards are arranged on the lower side of the connecting member 55. The plurality of hydraulic cylinders 15 are arranged at equal intervals in the circumferential direction and the rod upper end of each hydraulic cylinder 15 is arranged corresponding to the lower end portion of the cylindrical connecting member 55. Furthermore, each hydraulic cylinder 15 is urged upward, so that when the connecting member 55 is pushed downward, the rod descends (contracts) against the urging force to accumulate the force. As will be explained later, when the back pressure plate 40, the back pressure transmission bar 45, the back pressure transmission plate 50 and the connecting member 55 are pushed downward by the downward load when the forging material W1 is driven into the shaping hole 22 by the punch 1, the hydraulic cylinder 15 contracts against the urging force. Thus, the upward resistance force by the urging force functions as a back pressure, and the back pressure is applied to the metallic material in the shaping hole 22 via the connecting member 55, the back pressure transmission plate 50, the back pressure transmission bar 45, and the back pressure plate 40.

A through-hole 11 is provided at the center of the bottom wall of the base stand 10, and a knockout pin 6 is provided in the through-hole 11 slidably in the up-and-down direction. Furthermore, the knockout pin 6 is arranged coaxially with the die receiving member 12 in the die receiving member 12. The knockout pin 6 is formed so that the outer diameter is smaller than the inner diameter of the through-hole 51 of the back pressure transmission plate 50, so that the knockout pin 6 can be inserted into the through-hole 51.

Figure 1D:
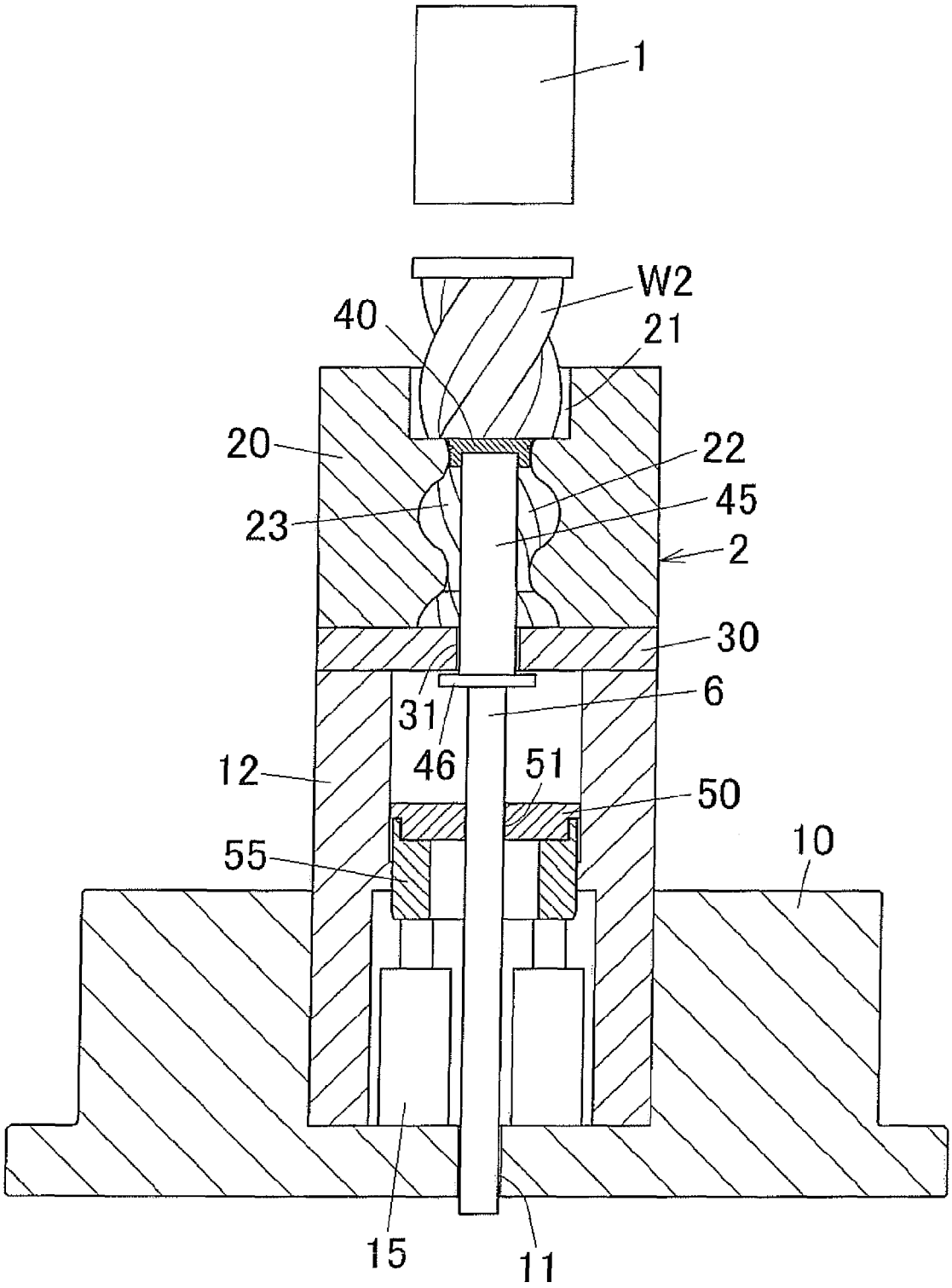
FIG. 1D is a front cross-sectional view showing the forging device of the embodiment in a state of discharging a work.

Furthermore, the knockout pin 6 is configured to be driven in the up-and-down direction by a lifting and lowering drive mechanism not shown in the figures. As shown in FIGS. 1A to 1C, in a state in which the knockout pin 6 is descended, the knockout pin 6 is arranged in the space surrounded by a plurality of hydraulic cylinders 15 and in the cylindrical connecting member 55, and the upper end of the knockout pin 6 is arranged so as to face the lower end of the back pressure transmission bar 45 via the through-hole 51 of the back pressure transmission plate 50. When the knockout pin 6 ascends from the state, as shown in FIG. 1D, the knockout pin 6 comes into contact with the lower end of the back pressure transmission bar 45 via the through-hole 51 of the back pressure transmission plate 50 and pushes the back pressure transmission bar 45 upwards. At this time, the knockout pin 6 ascends without rotating about the axis, while the back pressure transmission bar 45 ascends while rotating about the axis together with the back pressure plate 40. When the knockout pin 6 at the ascended position descends, the back pressure plate 40 and the back pressure transmission bar 45 descend to the initial state as shown in FIG. 1A due to their self-weights.

In this embodiment, the back pressure plate 40, the back pressure transmission bar 45, the back pressure transmission plate 50, and the connecting member 55 constitute a back pressure transmission mechanism. Furthermore, the back pressure plate 40 and the back pressure transmission bar 45 constitute a rotation-side transmission member, and the back pressure transmission plate 50 and the connecting member 55 constitute a non-rotation-side transmission member.

Furthermore, the lower end of the back pressure transmission bar 45 constitutes a lower end of the rotation-side transmission member.

In this embodiment, a plurality of hydraulic cylinders 15 arranged at equal intervals about the axis constitute a back pressure generation mechanism. Furthermore, this back pressure generation mechanism is arranged in a non-rotatable state about the axis.

A space surrounded by the plurality of hydraulic cylinders 15 of the back pressure generation mechanism constitutes a through-hole portion in which the knockout pin 6 extending along the axis can be arranged in an insertable manner.

The through-hole 51 of the back pressure transmission plate 50 constitutes a through-hole portion in which the knockout pin can be arranged in an insertable manner.

Furthermore, the cylindrical hole of the cylindrical connecting member 55 constitutes a through-hole portion in which the knockout pin can be arranged in an insertable manner.

The knockout pin 6 constitutes a knock-up mechanism to upwardly knock up the rotation-side transmission portion constituted by the back pressure plate 40 and the back pressure transmission bar 45.

Forging Process

Next, the forging process for producing the forged product W3 in the forging device of this embodiment will be explained.

In the initial state (state immediately before shaping) as shown in FIG. 1A, the back pressure transmission bar 45 is arranged on the back pressure transmission plate 50 so that the back pressure plate 40 is arranged slightly upward from the lower end position in the shaping hole 22. The punch 1 is in an ascended position, and the forging material W1 as a work is arranged in the work mounting hole 21. The oil grooves 43 of the back pressure plate 40 are filled with lubricant.

In the forging condition, the punch 1 and the die 2 are subjected to a lubrication treatment with a water-soluble lubricant. In this embodiment, the forging material W1 is not subjected to a lubrication treatment, but there are no problems even if the forging material W1 is subjected to a lubrication treatment.

The pre-heating temperature of the forging material W1 is preferably set to 400 to 450° C. The temperature of the punch 1 and the die 2 (die temperature) is preferably set to 100 to 300° C., more preferably 150 to 250° C.

Furthermore, the load of the punch 1 is preferably set to $1.5\times10^6$N to $2.5\times10^6$N (around 150 t to 250 t).

From this state, the punch 1 is driven into the work mounting hole 21 by descending the punch 1. With this, as shown in FIG. 1B, the forging material W1 in the work mounting hole 21 is press-fitted while being screwed in and plastically flowing in the shaping hole 22, so that the forging material W1 is press-formed so as to correspond to the inner peripheral surface shape of the shaping hole 22.

When the punch 1 further descends, the lower end of the forging material W1 comes into contact with the back pressure plate 40, and the metallic material (metal) constituting the forging material W1 is forged while being pushed downward together with the back pressure plate 40. During the process, a back pressure is applied to the metallic material. That is, the back pressure plate 40 and the back pressure transmission bar 45 are pushed downward while rotating about the axis by being pushed by the metallic material, and the back pressure transmission plate 50 and the connecting member 55 are pushed downward by the back pressure transmission bar 45, thereby contracting the hydraulic cylinder 15. The upward resistance force at the time of the contraction functions as a back pressure and the back pressure is applied to the metallic material via the back pressure transmission mechanism including the connecting member 55, the back pressure transmission plate 50, the back pressure transmission bar 45, and the back pressure plate 40.

Since the metallic material is forged while receiving the back pressure, the metallic material thoroughly and smoothly spreads in the radially outward direction (toward the outer peripheral edge portion) perpendicular to the axial direction and fills the shaping hole 22 without causing voids. Therefore, defects such as underfill would not occur and an excellent forged article W2 having small droops can be formed.

In this embodiment, the back pressure plate 40 descends while rotating in a state in which the bottom surface of the forging material W1 is in contact with the back pressure plate 40 as a rotation-side transmission member, guiding the forging material W1 to flow, which forms helical protruded portions.

As a result, the metal flow of the helical protruded portion as a robe 91 becomes continuous, which results in a preferred forged product in terms of the strength of the robe 91.

Furthermore, at the time of shaping, since the forging material W1 is in contact with the back pressure plate 40, the forging material W1 is processed while being restrained by a wide contact surface. Therefore, the forging material W1 is processed in a state in which the forging material W1 is in close contact with the die 2, improving the dimensional accuracy, which is preferable in terms of preventing occurrence of drooping as forging defects.

Figure 2:
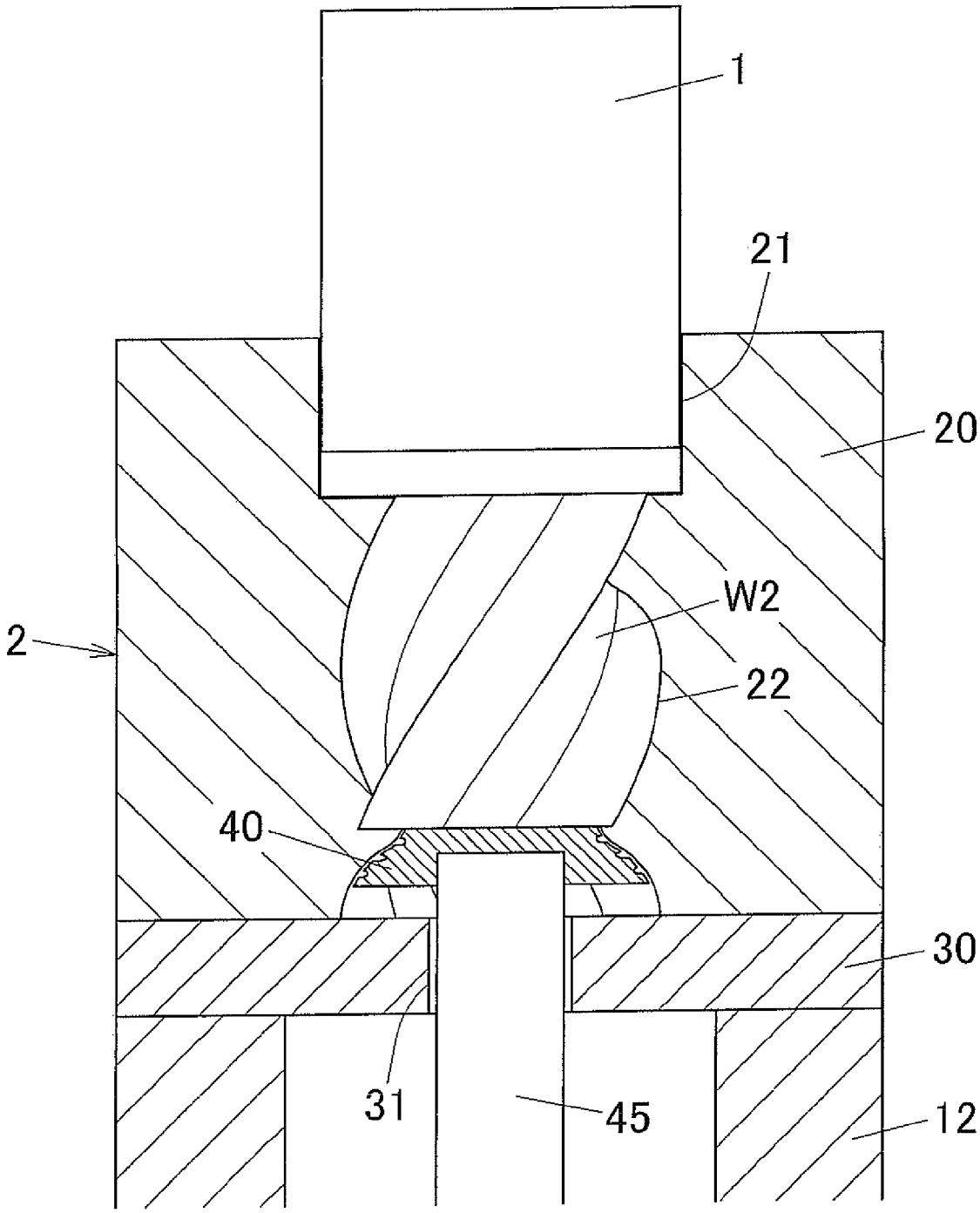
FIG. 2 is a front cross-sectional enlarged view showing the shaping hole of the forging device of FIG. 1C and the vicinity thereof.

On the other hand, in a state immediately after shaping in which the punch 1 has been descended to the lowest position, the back pressure plate 40 does not descend to the lowest end position of the shaping hole 22 and is slightly lifted up from the upper surface of the anvil 30 as shown in FIG. 1C and FIG. 2. That is, the downward load immediately before completion of shaping is received by the urging force (back pressure) of the hydraulic cylinder 15. Therefore, the load immediately before completion of descending the punch 1 can be absorbed naturally, which prevents occurrence of shocks at the time of completion of the descending operation of the punch 1. For example, at the time of completion of descending the punch, in contrast to the case in which the back pressure plate 40 collides with the anvil 30, adverse effects to the back pressure plate 40 and the forged article W2 by the shock from the collision can be prevented.

After completion of shaping, as shown in FIG. 1D, the punch 1 ascends and subsequently, the knockout pin 6 ascends. With this, the back pressure transmission bar 45, the back pressure plate 40, and the forged article W2 are knocked-up by the knockout pin 6 and ascends while rotating in a direction opposite to a direction at the time of shaping. In this way, a forged article W2 is discharged from the shaping hole 22 to be arranged in the work mounting hole 21.

In this embodiment, the back pressure plate 40 ascends while rotating in a state in which the entire bottom surface of the shaped forged article W2 is in contact with the back pressure plate 40. During the ascending operation, the back pressure plate 40 and the forged article W2 can be brought into contact with each other with a wide contact surface, thereby giving a sufficient torque to the forged article W2. As a result, even if the helical groove 92 of the forged article W2 is deep, a forged article W2 can be discharged easily and assuredly without causing deformations and/or breakages of the helical protruded portion (robe 91).

The forged article W2 discharged above the shaping hole 22 is picked up by a work transportation mechanism not illustrated and carried out from the forging device.

At the time of the discharging, even if the back pressure plate 40 is adhered to the forged article W2, occurrences of transportation defects such that the back pressure plate 40 is picked up by a work transportation mechanism and transported together with the forged article W2 can be assuredly prevented. That is, in this embodiment, since the back pressure transmission bar 45 is fixed to the bottom surface of the back pressure plate 40, a certain level of weight is secured by the back pressure plate 40 and the back pressure transmission bar 45. Therefore, when the forged article W2 is picked up by the work transportation mechanism, the back pressure plate 40 and the back pressure transmission bar 45 are smoothly detached from the forged article W2 by the weight, which prevents transportation defects.

Furthermore, in this embodiment, even in cases where the back pressure plate 40 and the back pressure transmission bar 45 fail to separate from the forged article W2 by the self-weight, the back pressure plate 40 can be assuredly detached from the forged article W2. That is, since the retaining flange 46 is provided at the bottom end of the back pressure transmission bar 45, even if the back pressure plate 40 and the back pressure transmission bar 45 fail to separate from the forged article W2 when the forged article W2 is picked up by the work transportation mechanism, the retaining flange 46 of the back pressure transmission bar 45 comes into contact with and is engaged with the lower surface of the anvil 30. This causes a separation of the back pressure plate 40 and the back pressure transmission bar 45 from the forged article W2 to prevent them from being pulled out. Therefore, transportation defects can be prevented more assuredly.

After the forged article W2 is transported, the device returns to the initial state. That is, the knockout pin 6 descends, the back pressure plate 40 and the back pressure transmission bar 45 descend while rotating due to the self-weight, and the back pressure transmission bar 45 is arranged on the back pressure transmission plate 50.

While the forged article W2 is being discharged by the knockout pin 6, the non-rotation-side transmission member such as the back pressure transmission plate 50 and the connecting member 55 slightly ascend due to the urging force of the hydraulic cylinder 15 and return to the initial position.

In this way, a forged article W2 as shown in FIGS. 4A and 4B is obtained. Furthermore, a forged product W3 as shown in FIGS. 3A to 3C is obtained by cutting the excess portion 95 of the forged article W2.

The excess portion 95 of the forged article W2 does not always need to be cut out. For example, the excess portion 95 can be used as a chucking portion when mechanically processing the forged article W2.

Effects

As explained above, according to the forging device of this embodiment, a back pressure is applied when a forged article W having a twisted shape is formed by forging. Therefore, the flowing property of the metallic material during shaping is excellent and the metallic material sufficiently spreads to and assuredly fills the outer peripheral edge portion (outside) of the shaping hole 22. Therefore, a high-quality forged article W2 having no defects such as underfill can be formed.

Additionally, in this embodiment, the protruded portion 42 is formed at the central region (inner region) of the surface (upper surface) of the back pressure plate 40 facing the forging material W1. The protruded portion 42 also facilitates and increases the flow of the metallic material to the outer peripheral edge portion during shaping. Therefore, the metallic material can be further and assuredly filled to every corner of the shaping hole 22 to assuredly form a high-quality forged article W2.

Figure 7A:
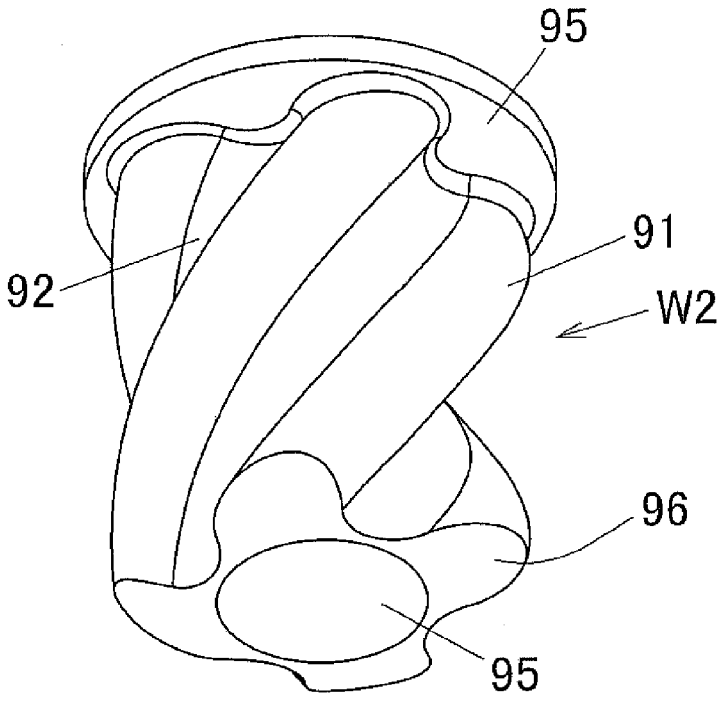
FIG. 7A is a perspective view showing a forged article of a reference embodiment deviating from the gist of the present invention.
Figure 7B:
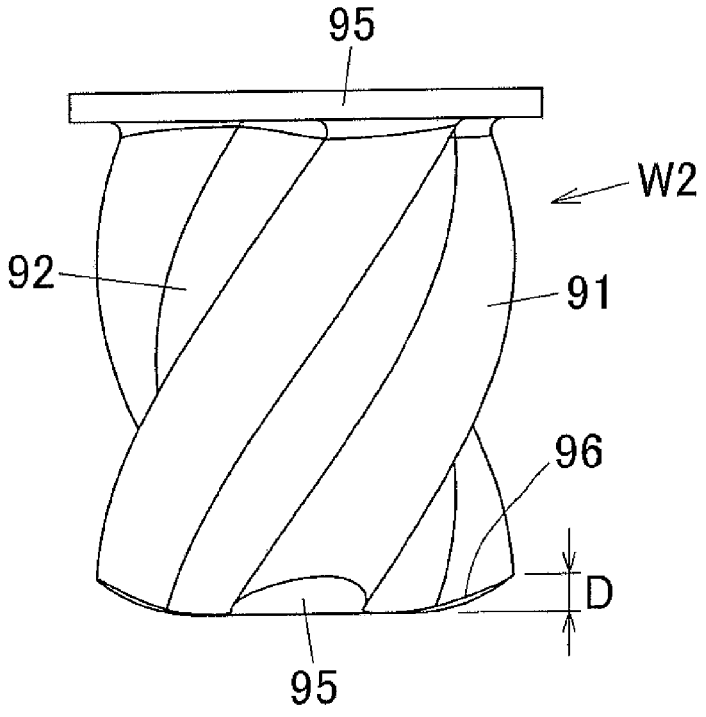
FIG. 7B is a front view showing the forged article of the reference embodiment.

In cases where a back pressure is not applied when forging a forged article W2 having a twisted shape as shown in FIGS. 7A and 7B, spreading of the metallic material toward the outer peripheral edge portion during the shaping becomes insufficient. Especially since the blade portion 23 of the shaping hole 22 is twisted, spreading of the metallic material at the portion corresponding to the tip end portion (lower end portion) of the forged article W2 becomes insufficient, which results in a large axial dimension D of the (droop) portion 96 in which the metallic material is not filled at the outer periphery of the front end portion. Since the portion corresponding to the droop 96 is subjected to be cut out as an excess portion 95, in the forged article W2 having a large droop dimension D, an excessive metallic material (forging material W1) is wasted. This prevents effective use of the material, resulting in an increased cost.

On the other hand, in the forging device of this embodiment, as explained above, the forging is performed while applying a back pressure and a protruded portion 42 for improving the fluidity of the metallic material is formed on the back pressure plate 40. Therefore, during the shaping, even at the portion corresponding to the tip end portion (lower end portion) of the forged article W2, the metallic material assuredly spreads toward the outer peripheral edge portion. Therefore, as shown in FIGS. 4A and 4B, almost no droop 96 is generated, and the droop dimension D can be kept extremely small. Therefore, the excess portion 95 corresponding to the droop 96 is significantly reduced, enabling effective use of the metallic material, which in turn can reduce the production cost.

Also, in the forging device of this embodiment, the back pressure plate 40 is shaped into a shape conforming to the shaping hole 22, and when the back pressure plate 40 is moved in the axial direction (in the up-and-down direction), the back pressure plate 40 naturally rotates while being guided by the inner peripheral surface of the shaping hole 22. That is, a force for rotating the back pressure plate 40 and a mechanism for transmitting the force are not needed. Therefore, the mechanism can be simplified, the size and weight of the device can be reduced, and the cost reduction can further be attained.

Furthermore, in this embodiment, it is structured such that the back pressure transmission bar 45 fixed to the back pressure plate 40 is arranged so as to come into contact with the back pressure transmission plate 50 in a rotatable manner and therefore it is not required to rotate the back pressure generation mechanisms, such as, e.g., the back pressure transmission plate 50, the connecting member 55, the hydraulic cylinder 15, etc., about the axis. Therefore, a mechanism and a force for rotating such non-rotation-side transmission members 50 and 55 and the back pressure generation mechanism 15 are not required, which can further simplify the structure, reduce the size and weight of the device, and attain the cost reduction.

Further, in this embodiment, when knocking-up the forged article W2 after shaping, the upper end of the knockout pin 6 is brought into sliding contact with the back pressure transmission bar 45 in a non-rotatable state. Therefore, in this regard, a mechanism and a force for rotating the knockout pin 6 are not required, which assuredly and further can simplify the structure, reduce the size and weight of the device, and attain the cost reduction.

Also, in this embodiment, the oil grooves 43 are formed on the outer peripheral surface of the back pressure plate 40 so that lubricant is stored in the grooves 43. Therefore, when the back pressure plate 40 moves up and down while rotating during shaping, the lubricant is moderately supplied to the inner peripheral surface of the shaping hole 22 from the oil grooves 43. Therefore, the shortage of oil can be prevented, which effectively prevents the occurrence of defects such as seizure.

Also, in this embodiment, the back pressure plate 40 is screwed and fixed to the back pressure transmission bar 45 and the rotational direction in which the back pressure plate 40 rotates while ascending is set to the direction in which the screw is tightened. This hardly causes loosening of the screwed portion, which can maintain the excellent connection state of the back pressure plate 40 and the back pressure transmission bar 45 for a long period of time.

Modified Embodiment

In the aforementioned embodiment, the back pressure plate 40 and the back pressure transmission bar 45 constitute a rotation-side transmission member and the back pressure transmission plate 50 and the connecting member 55 constitute a non-rotation-side transmission member, but not limited to it.

For example, in the present invention, the back pressure transmission bar 45 can be included in the non-rotation-side transmission member. That is, the lower end of the back pressure transmission bar 45 is fixed to the back pressure transmission plate 50 in a state in which a relative rotation is restrained so as not to allow the rotation of the back pressure transmission bar 45. Furthermore, the lower surface of the back pressure plate 40 is arranged rotatably about the axis on the upper end of the back pressure transmission bar 45 in a contactable manner. In this case, the lower surface of the back pressure plate 40 constitutes the lower end of the rotation-side transmission member. Also in this construction, only the back pressure plate 40 rotates when moving up and down, and the back pressure transmission bar 45, the back pressure transmission plate 50, and the connecting member 55 do not rotate when moving up and down. Therefore, the back pressure plate 40 constitutes the rotation-side transmission member, and the back pressure transmission bar 45, the back pressure transmission plate 50, and the connecting member 55 constitute the non-rotation-side transmission member.

Also, the back pressure transmission plate 50 can be included in the rotation-side transmission member. That is, the upper surface of the back pressure transmission plate 50 is fixed to the lower end of the back pressure transmission bar 45 in a state in which a relative rotation is restrained and the lower surface of the back pressure transmission plate 50 is arranged rotatable about the axis on the upper end of the connecting member 55 in a contactable manner. In this case, the lower surface of the back pressure transmission plate 50 constitutes the lower end of the rotation-side transmission member. And in this construction, the back pressure plate 40, the back pressure transmission bar 45, and the back pressure transmission plate 50 rotate when moving up and down, and the connecting member 55 does not rotate when moving up and down. Therefore, the back pressure plate 40, the back pressure transmission bar 45, and the back pressure transmission plate 50 constitute the rotation-side transmission member, and the connecting member 55 constitutes the non-rotation-side transmission member.

Furthermore, in the present invention, the connecting member 55 can be omitted and the back pressure transmission plate 50 can be directly connected to a back pressure generation mechanism such as the hydraulic cylinder.

Also, in the aforementioned embodiment, the explanation is directed to the case in which the knockout pin 6 goes through the back pressure transmission plate 50 and the connecting member 55 as a non-rotation-side transmission member in a state in which the knockout pin 6 is ascended, but the present invention is not limited to that. It is not always required that the knockout pin 6 goes through the back pressure transmission plate 50.

Figure 8A:
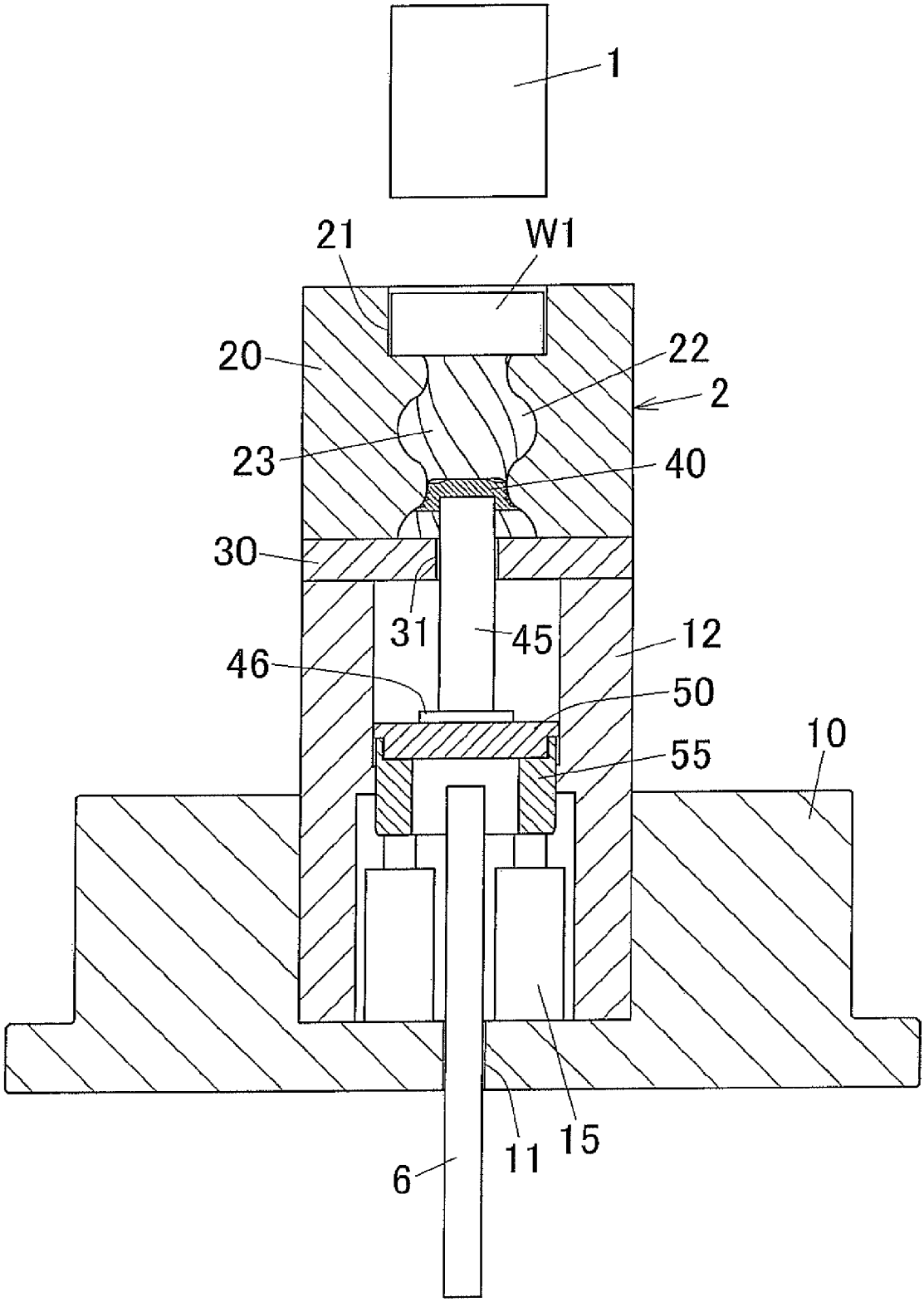
FIG. 8A is a cross-sectional front view showing a forging device as a modified embodiment of the present invention in a state immediately before starting the shaping operation.

For example, in the forging device of a modified embodiment as shown in FIG. 8A, a through-hole (see the through-hole 51 shown in FIG. 1D) is not formed in the back pressure transmission plate 50 provided on the connecting member 55. Furthermore, in the initial state, the knockout pin 6 is arranged corresponding to the lower part of the back pressure transmission plate 50.

Figure 8B:
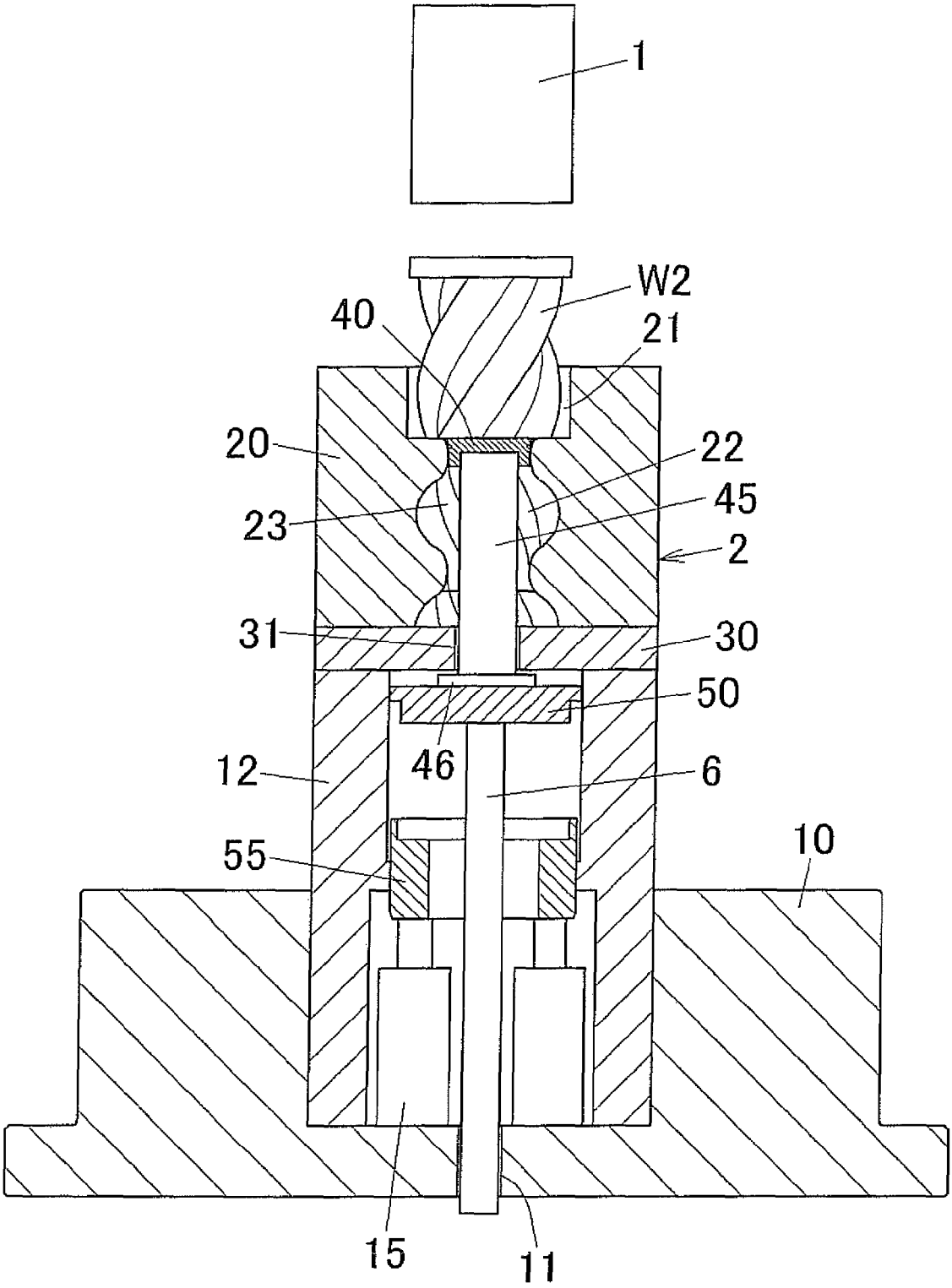
FIG. 8B is a cross-sectional front view showing the forging device of the modified embodiment in a state of discharging a work.

After the shaping, when discharging the forged article W2, as shown in FIG. 8B, the knockout pin 6 ascends to push up the back pressure transmission plate 50, and therefore the back pressure transmission bar 45 and the back pressure plate 40 are knocked-up via the back pressure transmission plate 50. With this, in the same manner as in the aforementioned embodiment, the rotation-side transmission member and the forged article W2 ascend while rotating and are discharged upwards.

In this modified embodiment, in contrast to the aforementioned embodiment, the knockout pin 6 is configured not to go through the non-rotation-side transmission member such as the back pressure transmission plate 50.

In this modified embodiment, the knockout pin 6 and the back pressure transmission plate 50 constitute a knock-up mechanism.

In the forging device of this modified embodiment, it can be configured such that the knockout pin 6 comes into contact with the back pressure transmission plate 50 in a freely rotatable manner, or the back pressure transmission plate 50 comes into contact with the rotation-side transmission member in a rotatable manner. Furthermore, it can be configured such that the knockout pin 6 and the back pressure transmission plate 50, and the back pressure transmission plate 50 and the rotation-side transmission member come into contact with each other in a rotatable manner, respectively.

In the aforementioned embodiment, the explanation was made by exemplifying the case in which the knockout pin 6 does not rotate about the axis, but the present invention is not limited to that. It is not always required that the rotation of the knockout pin 6 is restrained.

For example, a knockout pin can be configured so as to be moved up and down without restraining the rotation of the knockout pin by rotating a cam contacting the lower end of the knockout pin. With this, it can be configured that the knockout pin can rotate during the ascending operation. In the case of making the knockout pin rotate, the knockout pin is rotated in synchronization with the rotation-side transmission member, and the knockout pin is arranged so as to come into contact with the cam in a rotatable manner. Alternatively, it can be configured such that the knockout pin is slowly rotated with respect to the rotation-side transmission member by sliding the knockout pin with respect to the rotation-side transmission member, and the knockout pin is slowly rotated with respect to a cam by sliding the knockout pin with respect to the cam.

Even in cases where the knockout pin is moved up and down with a cam, it can be configured such that the knockout pin is arranged so as to come into contact with the rotation-side transmission member in a rotatable manner without rotating the knockout pin like in the aforementioned embodiment.

Also, in the present invention, it is also possible to constitute the die 2 only by the die main body 20, and the bottom wall member such as the anvil 30 is omitted. In that case, the lower end opening portion of the shaping hole 22 constitutes the lower opening portion.

In the aforementioned embodiment, the explanation is made by exemplifying the case in which a rotor component having four-leaf twist robes as a forged product is produced, but the present invention is not limited to that. The present invention can be applied to produce various components having shapes different from the shape mentioned above, for example, a rotor component having a two-leaf or three-leaf twist robes.

In the aforementioned embodiment, the groove 92 having a twisted shape is formed along the entire axial direction of the forged product W3, but the present invention is not limited to that, and a twisted groove 92 can be formed at only a portion of the forged product.

In the aforementioned embodiment, a hydraulic cylinder is employed as the back pressure generation mechanism, but the present invention is not limited to that, and other fluid pressure cylinders such as, a gas cylinder, a rubber member, a coiled spring, etc., can be employed.

In the present invention, the back pressure transmission bar can be a solid shaped member or a hollow shaped member of a pipe shape.

The present invention claims priority to Japanese Patent Application No. 2010-284453 filed on Dec. 21, 2010, the entire disclosure of which is incorporated herein by reference in its entirety.

The terms and descriptions used herein are used only for explanatory purposes and the present invention is not limited to them. The present invention allows various design-changes falling within the claimed scope of the present invention unless it deviates from the spirits of the invention.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

INDUSTRIAL APPLICABILITY

The forging device of the present invention can be applied to a forging technologies for forging a work using a die.

DESCRIPTION OF THE REFERENCE NUMERALS

1: punch (upper died)
15: hydraulic cylinder (back pressure generation mechanism)
2: die (lower die)
22: shaping hole
23: blade portion
40: back pressure plate (rotation-side transmission member)
41: engaging dented portion
42: protruded portion
43: oil groove
45: back pressure transmission bar (rotation-side transmission member)
46: retaining flange (retaining portion)
50: back pressure transmission plate (non-rotation-side transmission member)
51: through-hole (through-portion)
55: connecting member (non-rotation-side transmission member)
6: knockout pin (knock-up mechanism)
W1: forging material
W2: forged article
W3: forged product
92: groove
95: excess portion

The invention claimed is:

1. A forging device equipped with a die having a shaping hole having upper and lower open ends and a helical blade portion formed on an inner peripheral surface of the shaping hole, a punch arranged on an upper side of the shaping hole coaxially with the shaping hole, whereby a forging material is driven into the shaping hole from above by the punch to form a forged article having a helical groove corresponding the blade portion on an outer peripheral surface thereof, the forging device comprising:

a back pressure generation mechanism arranged on a lower side of the shaping hole non-rotatably about an axis, and a back pressure transmission mechanism arranged to transmit a back pressure by the back pressure generation mechanism to a metallic material as the forging material to be driven into the shaping hole, wherein the back pressure transmission mechanism includes a rotation-side transmission member arranged rotatably about the axis, and a non-rotation-side transmission member arranged on a lower side of the rotation-side transmission member non-rotatably about the axis, a lower end of the rotation-side transmission member is arranged so as to come into contact with an upper end of the non-rotation-side transmission member rotatably about the axis, the rotation-side transmission member includes a back pressure plate for restraining a lower end of the metallic material at the time of shaping, an engaging dented portion is formed on an outer peripheral portion of the back pressure plate corresponding to the blade portion, the back pressure plate is arranged in the shaping hole in a state in which the engaging dented portion is engaged with the blade portion slidably in an up-and-down direction, and when the forging material is driven into the shaping hole and the back pressure plate is pressed downward by the metallic material, the engaging dented portion of the back pressure plate is guided by the blade portion and thereby the back pressure plate descends while rotating about the axis, and a back pressure by the back pressure generation mechanism is applied to the metallic material via the back pressure transmission mechanism.

2. The forging device as recited in claim 1, further comprising a knock-up mechanism configured to knock up the rotation-side transmission member upward, wherein when discharging the forged article in the shaping hole upward, the rotation-side transmission member is knocked up by the knock-up mechanism and thereby the rotation-side transmission member is moved upward together with the forged article while rotating about the axis by being guided by the blade portion.

3. The forging device as recited in claim 2, wherein the rotation-side transmission member includes a back pressure transmission bar arranged in a lower opening portion of the shaping hole in an inserted manner, and wherein an upper end of the back pressure transmission bar is fixed to a lower surface of the back pressure plate relatively non-rotatably about the axis.

4. The forging device as recited in claim 3, wherein the back pressure transmission bar is provided, at its lower end outer periphery, with a retaining portion, and wherein the retaining portion is configured to be engaged with a lower side opening peripheral edge of the shaping hole of the die to prevent the back pressure plate and the back pressure transmission bar from being pulled out upward.

5. The forging device as recited in claim 1, wherein the back pressure plate is provided, at its outer peripheral side surface, with an oil groove for retaining lubricant to be supplied to the shaping hole.

6. The forging device as recited in claim 1, wherein the back pressure plate is provided, at its upper surface inner side, with a protruded portion for increasing a flow of the metallic material toward an outer peripheral portion of the shaping hole.

7. The forging device as recited in claim 1, wherein in a state in which a descending operation of the punch has been completed, a height of the back pressure plate in the shaping hole is held by a back pressure by the back pressure generation mechanism.

8. A production method of a forged product, the method comprising the steps of:

obtaining the forged article using the forging device as recited in claim 1; and obtaining the forged product by cutting out an excess portion of the forged article.

9. A forging method comprising the steps of: arranging a die having a shaping hole with upper and lower open ends and a helical blade portion formed on an inner peripheral surface of the shaping hole; and driving a forging material into the shaping hole from above by a punch arranged on an upper side of the shaping hole coaxially with the shaping hole to thereby form a forged article having a helical groove corresponding the blade portion on an outer peripheral side surface of the forged article, the forging method further comprising the steps of:

preparing a back pressure plate having an engaging dented portion corresponding to the blade portion on an outer peripheral portion, the back pressure plate being configured to restrain a lower end of the metallic material as the forging material at the time of shaping;

arranging the back pressure plate in the shaping hole in a state in which the engaging dented portion is engaged with the blade portion slidably in an up-and-down direction;

providing a back pressure generation mechanism on a lower side of the shaping hole non-rotatably about an axis;

providing a rotation-side transmission member including the back pressure plate rotatably about the axis;

providing a non-rotation-side transmission member between the rotation-side transmission member and the back pressure generation mechanism non-rotatably about the axis;

arranging a lower end of the rotation-side transmission member so as to come into contact with an upper end of the non-rotation-side transmission member rotatably about the axis, and when the forging material is driven into the shaping hole and the back pressure plate is pressed downward by the metallic material, the engaging dented portion of the back pressure plate is guided by the blade portion and thereby the back pressure plate descends while rotating about the axis, and a back pressure by the back pressure generation mechanism is applied to the metallic material via the back pressure transmission mechanism.

* * * * *